US007097121B2

(12) United States Patent
Giulano

(10) Patent No.: US 7,097,121 B2
(45) Date of Patent: Aug. 29, 2006

(54) COLOR SHUTTLE VALVE ARRANGEMENT OF A COATING PLANT

(75) Inventor: Stefano Giulano, Gerlingen (DE)

(73) Assignee: Behr Systems, Inc., Auburn Hills, MI (US)

( * ) Notice: Subject to any disclaimer, the term of this patent is extended or adjusted under 35 U.S.C. 154(b) by 202 days.

(21) Appl. No.: 10/899,998

(22) Filed: Jul. 27, 2004

(65) Prior Publication Data

US 2005/0029370 A1 Feb. 10, 2005

(30) Foreign Application Priority Data

Jul. 28, 2003 (DE) ..... 103 34 410

(51) Int. Cl.

| | |
|---|---|
| ***A62C 2/08*** | (2006.01) |
| ***A62C 31/00*** | (2006.01) |
| ***B05B 7/08*** | (2006.01) |
| ***B05B 1/14*** | (2006.01) |
| ***E03B 11/16*** | (2006.01) |

(52) U.S. Cl. ..... 239/548; 239/549; 239/551; 239/305; 137/565.01

(58) Field of Classification Search ..... 239/548, 239/549, 551, 305; 137/565.01, 240, 266; 427/421, 424, 426; 118/300, 621
See application file for complete search history.

(56) References Cited

U.S. PATENT DOCUMENTS

| | | | | |
|---|---|---|---|---|
| 3,201,048 | A | 8/1965 | Gibbs | 239/422 |
| 4,163,523 | A * | 8/1979 | Vincent | 239/305 |
| 4,422,576 | A * | 12/1983 | Saito et al. | 239/693 |
| 4,508,266 | A * | 4/1985 | Saito et al. | 239/3 |
| 4,846,226 | A | 7/1989 | Merritt | 137/871 |
| 5,676,756 | A * | 10/1997 | Murate et al. | 118/629 |
| 6,328,799 | B1 * | 12/2001 | Inoue et al. | 118/323 |
| 2003/0015607 | A1 | 1/2003 | Ehinger et al. | 239/526 |

FOREIGN PATENT DOCUMENTS

DE 43 39 301 A1 5/1995

OTHER PUBLICATIONS

European Search Report for EP 04 01 6360.

* cited by examiner

*Primary Examiner*—Davis Hwu
(74) *Attorney, Agent, or Firm*—Young & Basile, P.C.

(57) ABSTRACT

Valve assemblies for the color change valve arrangement of a coating plant, for example for the production coating of vehicle bodies, wherein various measures are proposed to miniaturize the needle valves forming the valve body of the color changer based on the principle of optimizing the drive device acting on the valve needles to open the valve against the force of a pressure spring.

13 Claims, 6 Drawing Sheets

COLOR SHUTTLE VALVE ARRANGEMENT OF A COATING PLANT

BACKGROUND OF THE INVENTION

1. Field of the Invention

The invention relates, in general, to a color change valve arrangement for selectively connecting an applicator of a coating plant to a plurality of supply lines for coating material of different selected colors.

2. Description of the Related Art

Valve arrangements for selectively connecting an applicator of a coating plant to a plurality of supply lines for coating material of different selected colors, which are needed in coating plants for the production coating of work pieces such as vehicle bodies, are known from DE 198 36 604 and DE 198 46 073 and others. These color change valve arrangements, or color changers for short, make it possible to switch quickly from one color to another during painting operations in paint plants and consist mainly of a plurality of controllable paint valve assemblies that are distributed along a paint passage common to all of them. To adapt to the particular plant and the number of selectable colors, they are formed in modular fashion from individual modules (connector blocks, manifold blocks, control heads) that can be stacked in rows so that a variable number of connections for paint lines, which can subsequently be enlarged or reduced, can be implemented. In addition to the paint valves there are usually additional, similarly-constructed valves for purging media such as solvent and pulse air. The valve assemblies consist for their part of pin or needle valves, whose valve needles are pressed into the closed position by a pressure spring and are opened against its force by a pneumatically-activated piston drive. The valve needles of the valve assemblies disposed next to each other along the normally straight central passage are moved in parallel planes which lie perpendicular to the axis of the central passage to improve flow characteristics but can also be disposed at an angle (DE 198 46 073, WO 02/09886). To save space, color changers are also known which in place of the customary straight central passage contain a spiral groove at right angles to the longitudinal axis of the color change block (DE 43 39 301). This, however, less conducive to flow than a straight central passage.

From EP 1 205 256 it is further known to have permanent pilot control of the paint and purging agent valves, using a pressurized air line common to all valve assemblies, and to actuate them by added electronically controlled solenoid valves. This dispenses with the required control air lines found in the normally pneumatically-controlled color changers.

In principle, color changers of the category under consideration here are distinguished by considerable advantages such as freedom from dead space, good purge capability, little dead volume, small size, low weight, modular construction, small number of different parts, ease of installation, maintenance and repair, etc. They have consequently proved their worth in practice for a long time. The disadvantage with the known color changers is their length in the longitudinal direction of the common central passage to match the number of selectable colors. As a result, the known color changers are relatively poorly suited to installation in confined areas of coating equipment, as for example painting robots, and even less suited to installation in the atomizer itself mounted on these machines, which may be desirable for the reasons explained in the co-pending application filed concurrently herewith in the name of Stefano Giuliano, which is entitled Spraying Device for Serial Spraying of Work Pieces.

An object of the invention is, therefore, to reduce the length of the color changer in the longitudinal direction of the central passage common to the valve assemblies and in particular to reduce the size of the valve assemblies perpendicular to the needle axes to a minimum without thereby prejudicing the required sealing effect of the valve needle pressed against the valve seat.

SUMMARY OF THE INVENTION

The starting point of the invention is that for safe and reliable operation of the valves, their needles (meaning any type of pins) must be pressed against the valve seat in the closed position with a force that must not fall below a specific minimum because of the required sealing effect. The invention is also based on the understanding that if this necessary minimum closing force is reduced and/or if the force available to overcome the minimum closing force is increased, possibilities open up of miniaturizing the valve assembly, specifically in a dimension perpendicular to the needle axis and thus in the longitudinal direction of the central passage. As a result, the color changer is more suitable than before for installation in small areas with restricted space characteristics, as for example, in relatively slender robot arms or relatively small atomizers. Through the achievable shortening of the central passage for a given number of paint valve assemblies, considerable additional advantages are gained in comparison with known color changers, such as still less dead volume, even lower paint and purging agent losses during a color change (by up to 85%), even faster and more efficient purging of the media carrying spaces and even lower weight.

The invention is suitable for color changers with or without paint recirculation (through the intrinsically known return lines) as a single color changer or also to create double color changers which, as is known, have common paint supply lines and are connected to the atomizer over separate paint runs. For example, especially compact color changer valve arrangements in accordance with the invention are well suited to creating double color changers. On the other hand, and in many cases particularly for shortening the central passage length, the advantageous possibility exists of arranging the valve assemblies in a star formation in which at least two, preferably at least three or four or more, valve assemblies whose outlet ports lie in a common plane perpendicular to the longitudinal axis of the central passage are disposed distributed around the longitudinal axis of the central passage. Preferably at least two or more additional valve assemblies whose outlet ports lie in a second plane parallel to the first are disposed around the longitudinal axis of the central passage distributed in such a way that the valve assemblies of the second plane lie in the circumferential direction of the central passage between the valve assemblies of the first plane. The result is a particularly compact arrangement in the longitudinal direction of the central passage, since the distance between the valves assemblies of the two planes can be smaller than the diameter of the valve assemblies measured in the longitudinal direction of the passage.

The reduction in accordance with the invention of the aforementioned minimum closing force necessary for the valves to be able to operate can be achieved in different ways. One expedient possibility consists in particular by forming the sealing surface of the valve needle opposite the surface of the valve seat, preferably including its face and/or the surface of the valve seat, from an elastomer material, so that due to the softer sealing materials a substantially better sealing effect can be achieved than before with relatively low force. The elastomer surface is suitably shaped so that no undercuts or dead spaces are created in which paint can be deposited such that it cannot be flushed free of all residue. Furthermore, the elastomer surface, similar to the previously customary valve needles and valve seats, is suitably formed so that the sealing edge lies as close as possible to the central passage and preferably at least approximately aligns with its inner wall (c.f DE 198 36 604). The surfaces in question of the valve needle and of the valve seat can run in linear fashion parallel to each other in the normal way or, for example, can run curved in the way described in DE 102 28 277, where the valve needle has an essentially spherical outer contour. A variation of the possibility described here is to use a spring element consisting of, for example, an elastomer O-ring in the interior of a needle tip produced from a plastic such as UHMPE or UHMWPE (polyethylenes with an ultra-high molar mass) such that the result is a flexibly yielding ("soft") needle tip.

It is already known to furnish the valve needles of the paint valves of a color changer adjoining the conical tip with an annular groove and an O-shaped seal ring located therein in order to achieve additional sealing (DE 198 46 073). By comparison, the invention has the advantage that undercuts and dead spaces created by the O-shaped seal ring are avoided. In such undercuts and dead spaces non-purgeable paint remnants can be deposited, become detached later and cause paint defects in the coating. The invention also has the advantage that the sealing edge of the needle can lie immediately against the central passage.

In the case of the color change valve arrangement described here, the closing force is preferably generated by a spring whose force must be overcome by the pressure medium of the piston drive device to open the valve. In this case, a further effective possibility exists for reducing the necessary minimum closing force by using a spring with a degressive characteristic. In this regard, the invention is based on the understanding that the greatest closing force is necessary only in the normal position of the closed valve, while when the valve is actuated, a magnitude of the application force to be overcome which decreases with piston stroke is desirable. Preferably, therefore, a pressure spring is used whose characteristic when compressed runs more or less (hard or soft) in a degressive curve. The same applies in the equally possible use of a tension spring in place of a compression spring.

Several different possibilities in accordance with the invention also exist for similarly effectively increasing the energy available to overcome the minimum closing force. The increase in energy should be achieved without making the valve assemblies larger in at least one dimension, specifically in the dimension corresponding to the diameter of the valve assembly perpendicular to the needle axis, that is to say in the dimension measured along the central passage. With the same energy exerted on the valve needle to overcome a given closing force, the increase in energy should rather be associated with a reduction of the dimension of the valve assembly in the said dimension. In other instances, however, an increase in the force exerted on the valve needle through the energy amplifying device without enlarging the stated dimension of the valve assembly can make sense.

A particularly simple constructional possibility of energy amplification consists in the use of a piston which has a non-circular, for example, a flat, rectangular or oval, cross-section on the surface pressurized by the pressure medium. The short axis of this cross-section should lie parallel to the direction in which the valve assembly is to be miniaturized, for example, in the longitudinal direction of the central passage. If this piston drive is compared with the previously customary valve drive using a cylindrical piston, the result with the same piston dimension in the direction of the short cross-sectional axis is substantially greater force (pressure x piston area) and, for the same force, a substantially narrower piston.

To increase the force generated by a piston of given area, the pressure of the medium pressurizing the piston can be increased in accordance with a further possibility. Since it would normally be impractical because of the associated expense to increase the pressure of 6 or at best 8 bar (dynamic minimum pressure) in the pressurized air systems of normal coating plants today, the pressurized air needed for the piston drive of the color change valve arrangement is to be preferably generated in a small, independent separate supply unit, which in many plants may already be available, for example for the cleaning slug equipment. This separate pressure elevating station can supply the valves of the color changer with a pressure of more than 10 bar, preferably at least 20 bar, in typical cases for example with about 25 bar. Instead of air, the pressure medium can also be a fluid for a hydraulic drive device to pressurize the piston.

In accordance with a further possibility, the drive device can further contain at least two piston surfaces, disposed for example one behind the other along the axis of piston motion, to each of which pressure is applied by the drive medium, which can be located in two piston cavities sealed off from each other or suitably coupled together in another way. For a given diameter of the valve assembly, a substantial increase in force is enabled thereby or, for the same force, a substantial reduction in size of the valve assembly perpendicular to the needle axis. More than two piston surfaces each pressurized by the drive medium can also be coupled to each other.

As a further possibility, the drive device to pressurize the piston can contain an energy converter to amplify the force of the pressure medium. A wide variety of energy converters can be employed, which normally are intended to convert a relatively low linear force into a higher linear force or, more generally, a given force or pressure component into a different linear force while amplifying the force. Some of the known principles which can be used for amplifying force are law of leverage, pulley, bell crank, shears, inclined plane, etc. Since the valve assemblies are designed in the usual way with a positive valve seat and the pressure medium is introduced on the side of the piston facing away from the central passage, force amplification can usefully be linked to a reversal of motion and/or to the conversion of linear into rotational motion and conversely. Embodiments will be explained in more detail hereinafter.

Especially small needle or pin-valve assemblies can be realized if, in accordance with a further possibility, the drive unit to which the pressure medium is supplied to actuate the valve is situated at a remote location outside the actual valve assembly of the color changer and is connected to said assembly by a preferably flexible mechanical drive element. With an arrangement of this type, a piston of large dimensions can be used to generate a correspondingly high force for the valve needle without taking up space in the valve assembly, which in consequence can be of extremely small dimensions. The connection can be created, for example, by means of a flexible control shaft (such as a Bowden cable or the like).

Suitable actuation of the valves can make a further contribution to miniaturization of the color changer, particularly insofar as their control lines are concerned. In themselves, the valve assemblies can be the same as known designs, for example FIG. 2 of DE 198 36 604, according to which the valve needle furnished with the piston is pressed by pressurized air against the force of a pressure spring into the open position in which it opens the way into the central passage for the paint or purging medium. In contrast to DE 198 36 604, in which the needle tip is pushed into the central passage to open the valve, in many cases the opposite opening direction can be more suitable (positive valve seat as in the aforementioned DE 198 46 073). Accordingly, the previously customary control technology using pneumatic hoses leading to the valves and solenoid valves installed in an external pneumatic cabinet can be used for the color changer described here. But in many cases, such as locating the color changer in an atomizer, in accordance with the similarly aforementioned EP 1 205 256, it can be more appropriate instead to incorporate a miniature pilot valve in the form of an electromagnetically-piloted pneumatic valve. The pneumatic valves for the paint or purging medium opening into the central passage of the color changer are actuated by pressurized air or another pressurized gas from a common pressurized gas line leading through the valve arrangement to all valves, and within the valve arrangement a solenoid valve replacing the conventional pressure connection can be inserted into the pressurized gas path of the pneumatic valves. The actuation of the solenoid valves is preferably managed using a data bus leading through the valve arrangement for digital control data, which is linked to the solenoid valves by way of an electronic circuit. The pilot valves can also be actuated piezo-electrically, instead of electromagnetically, allowing further miniaturization to be achieved.

A further possibility for miniaturizing the color changer consists in the attachment of a central control module of the type described in DE 101 42 355 (see FIGS. 7 to 9 there) located upstream from the valve assemblies. These control modules contain a valve common to the paint valves, whose pneumatic output signal can be taken to the particular paint valve to be actuated by way of a directional control unit. The unit contains a specific number of directional valves connected to each other in a common housing block through openings inside the housing block.

To reduce the length of the valve assemblies in the longitudinal direction of the needle and under certain conditions also to improve the electrical and/or hose-line arrangement it can be advantageous to house pilot valves for controlling the valves in a separate, for example, cylindrical or annular add-on control unit, which can be located in the space intended for the hose lines. The control unit can be connected to a common supply line and if necessary an electrical power cable for controlling the color changer, preferably with field bus control.

In many cases and particularly with the installation of the color changer in an atomizer, it may be appropriate to provide a quick-change coupling for all the connections of the color changer, which enables the rapid installation and removal of the color changer, and in addition good hose routing.

BRIEF DESCRIPTION OF THE DRAWING

The invention is explained in more detail with reference to the embodiments shown in the drawing wherein like reference numerals refer to like parts throughout the several views, and wherein.

DETAILED DESCRIPTION

Figure 1:
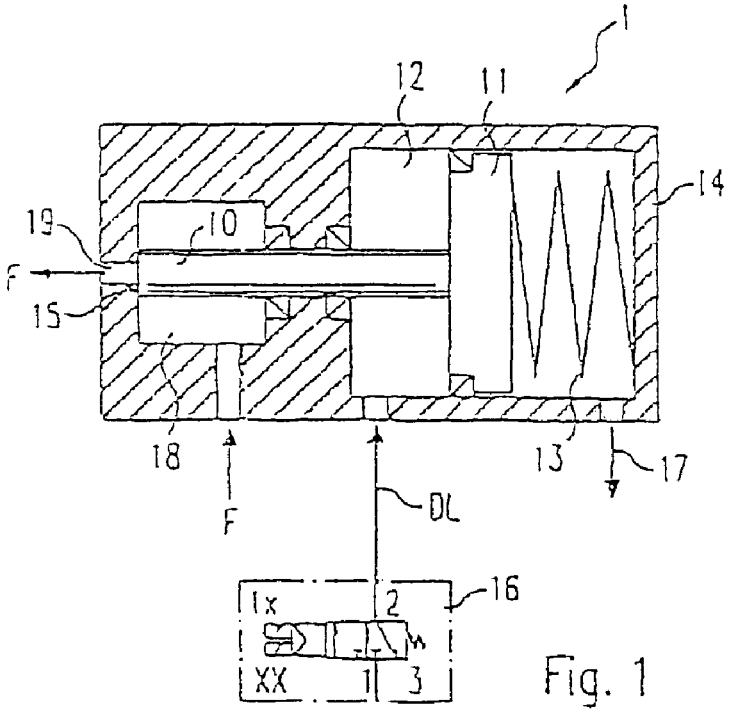
FIG. 1 shows a schematic representation of a valve assembly of the color changer.

With the exception of the cross-sectional shape of the piston, the valve assembly 1 of the color changer described shown in FIG. 1 corresponds to the prior art and contains accordingly a movably mounted valve needle 10, to which the peripherally sealed piston 11 is attached, the piston 11 movable in the cylinder cavity 12. A coil spring 13, which is seated against the valve housing 14, presses against the piston 11 on the side facing away from the cylinder cavity 12. The free end of the valve needle 10 is pressed by the spring 13 against the valve seat 15 of the housing 14 into its closed position, representing the normal position. To open the valve shown, pressurized air indicated by the arrow DL is led into the sealed cylinder cavity 12 by way of a control valve 16 (which can be located, for example, in a remote control cabinet when conventional control technology is used). The piston 11 is thereby pressed against the force of the spring 13 into the actuating position, in which the valve needle 10 is lifted from the valve seat 15 and opens the way for the controlled medium, for example, paint F which is led into the chamber 18 of the valve assembly 1 and exits through the open valve seat 15 into the central passage 19 of the color changer, here indicated only as an opening in the housing. The arrow 17 identifies the necessary venting.

Figure 1A:
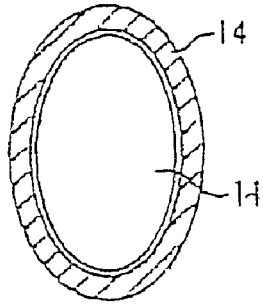

FIG. 1A is a section through the wall of the housing 14 surrounding the periphery of the piston 11 and the cylinder area 12, perpendicular to the direction of displacement and shows in this embodiment the oval cross-sectional shape of the piston 11 and of the housing 14 wherein they have in one transverse direction a shorter diameter and in the other transverse direction perpendicular thereto a longer diameter.

Figure 2:
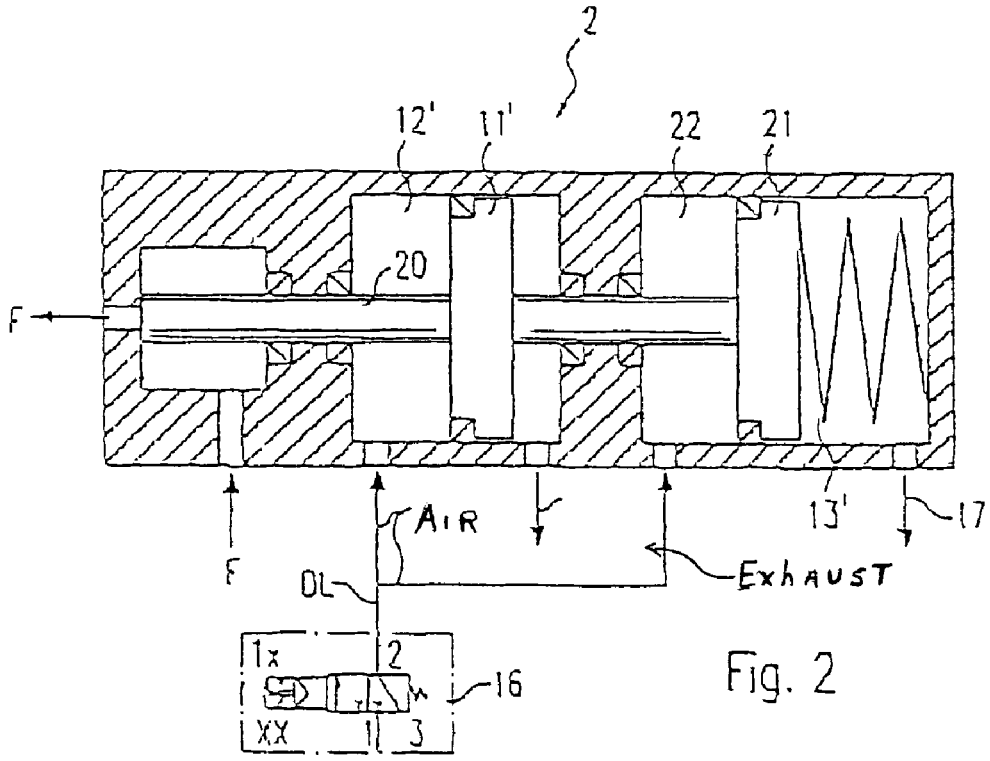
FIG. 2 shows the schematic representation of a valve assembly having two piston surfaces coupled to each other.

The modified valve assembly 2 shown in FIG. 2 differs from the embodiment in accordance with FIG. 1 in that, in accordance with the drawing, two pistons 11' and 21 spaced apart in the longitudinal direction of the needle are attached coaxially to the valve needle 20 and are carried movably in their own sealed off cylinder cavities 12' or 22. When the control valve 16 is open, pressure is applied therein to each by the pressurized air DL against the force of the spring 13'. For a given small diameter of the valve assembly 2, the force generated by the pressurized air can thereby be doubled.

Figure 3:
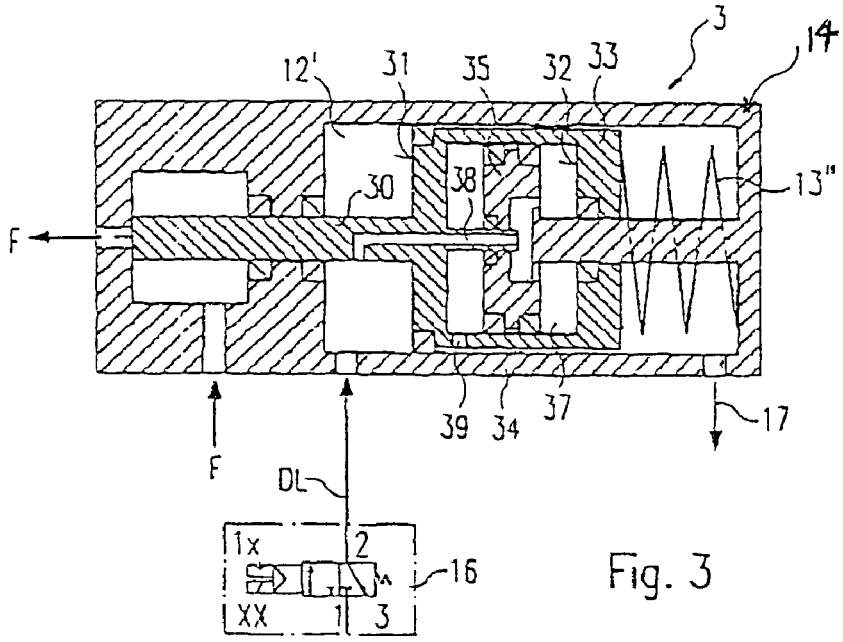
FIG. 3 shows another embodiment of a valve assembly having two piston surfaces coupled to each other.

In the case of the valve assembly 3 shown in FIG. 3, in principle similarly to FIG. 2, two piston surfaces 31 and 32 to which pressure is also applied simultaneously by the pressurized air are rigidly attached to the valve needle 30 and disposed one behind the other coaxially therewith in the longitudinal direction, so that the result is a similar increase in force. The two pistons here form a hollow cylinder body 33 with, for example, cylindrical or, as in FIG. 1A, oval cross-section which is carried movably in the housing 34 of the valve assembly 3. At its one outer side facing the valve seat the cylinder body 33 forms the first piston surface 31, and at the inner wall of its interior facing away from the first piston surface 31 the cylinder body 33 forms the second piston surface 32. The pressure spring 13" applies pressure at the outer side of the cylinder body 33 opposite to the first piston surface 31. With its cylindrical or oval inner wall, the cylinder body 33 slides on the correspondingly-shaped periphery of a guide body 35 rigidly connected to the housing 34. This body 35 seals the cylinder cavity 37 adjacent the second piston surface 32 from the other part of the interior of the cylinder body 33 on its other side. The said other interior section is vented through an opening 39 in the cylinder body 33. The pressurized air DL, as shown in the drawing, passes out of the cylinder cavity 12' of the housing 14 adjacent the piston surface 31 through a bore 38 leading through the valve needle 30 and the guide body 35 into the second cylinder cavity 37. Since the interior space of the cylinder body 33 is closed except for the vent opening 39, the two cylinder cavities 12' and 37 are also sealed off from each other.

Figure 4:
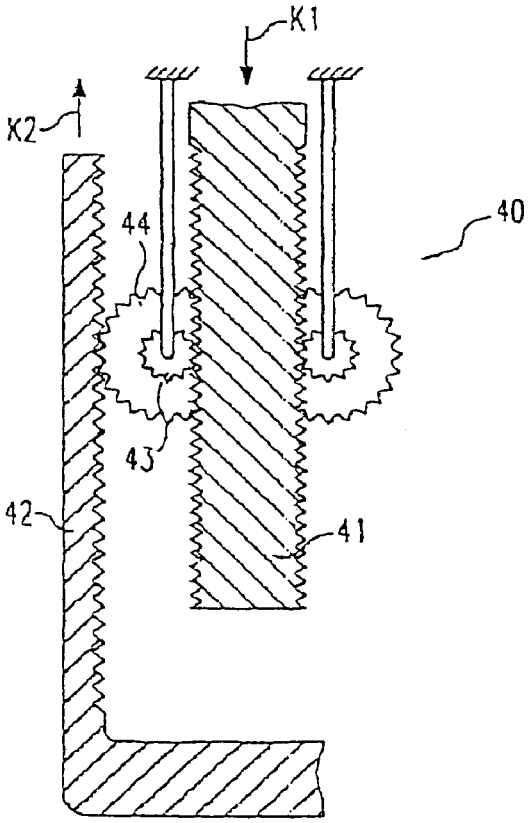
FIG. 4 is the schematic representation of a linear drive serving as an energy converter.

FIG. 4 shows a first embodiment of a suitable energy converter 40, suitable in at least one dimension to miniaturize the valve assembly, which is essentially formed by two racks 41 and 42 linearly parallel to each other, carried to be movable in opposite directions. The racks 41 and 42 are coupled to each other by means of a stationary, rotatably-mounted arrangement of two coaxial pinions 43 and 44 of different sizes fixedly connected on the same axis. When, for example, the input rack 41 is moved in the direction of the arrow K1 by the pressure available to actuate the valve, it transmits this motion to the small pinion 43 which meshes with it, while the larger pinion 44 being turned at the same time transmits the motion to the output rack 42. The rack 42 is thereby moved in the direction of the arrow K2 opposite to K1 and applies a force to the valve needle in this example that is greater than the force with which the rack 41 is being driven in proportion to the ratio between the pinions 43 and 44. The pinions and/or racks are preferably arranged at least in pairs in order to achieve a favorable balance of forces. In a further development of this embodiment, the one rack can be implemented as a hollow shaft with internal splining and the other rack as a shaft located in the hollow shaft with external splining, whereby a particularly space-saving construction results in the transverse direction. The intermediate pinions which are fixed relative to an outer housing can be carried internally as though in a cage in any number.

Coaxially coupled linear gears with two ball screws with different thread pitches are also feasible as energy converters for the purpose under consideration here. Ball screws are known intrinsically for converting rotary motion into linear motion and conversely, wherein the pitch of the spindle thread determines the transmission ratio. In accordance with a derivation of the linear gear described having a double ball screw, the drive unit for the valve needle can also be formed by a linear gear having a swivel drive and a spindle. In the manner known from swivel drives, a rotating piston can convert the rotary motion generated into a linear motion by means of the spindle and spindle nut.

Figure 5:
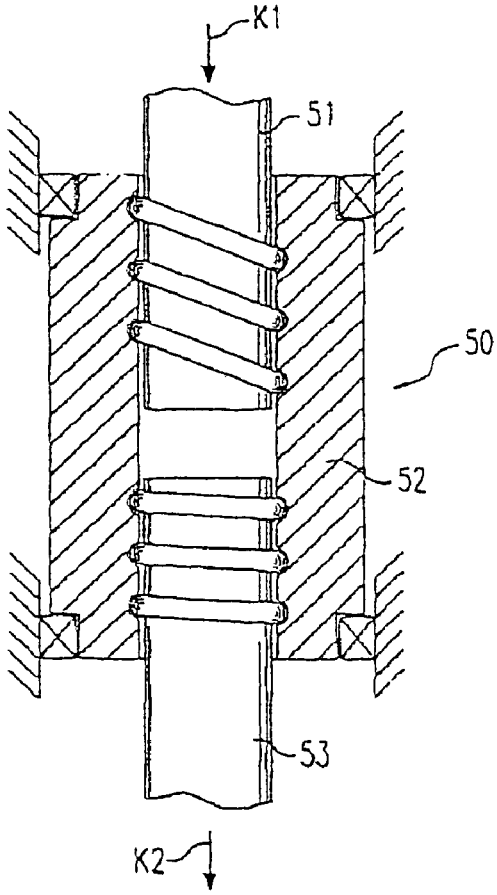
FIG. 5 is another embodiment of a linear drive serving as an energy converter.

As shown in FIG. 5, the energy converter 50 can contain a first spindle 51 driven in the direction of the arrow K1 (similar to FIG. 4), which turns the stationary nut element 52 having axially-spaced threaded sections of different pitch. The second spindle 53 sits in the other threaded section and is moved linearly in the same direction as the first spindle 51 by the rotary motion of the nut element 52 and exerts a force in the direction of the arrow K2 that is greater than the drive force of the first spindle 51 by an amount equal to the ratio between the different thread pitches.

The working principle described for the energy converters 40, 50 can also be reversed as needed, including the possibility of achieving opposing direction of motion of the spindles by using right-hand or left-hand threads.

Figure 6:
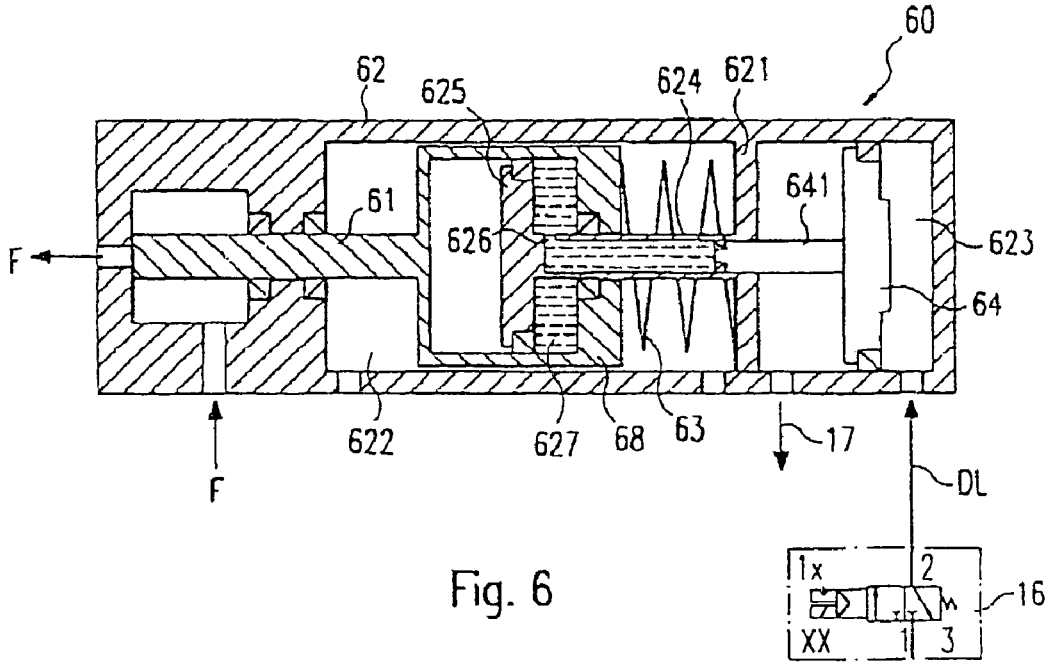
FIG. 6 is the schematic representation of a linear drive energy converter having fluid force amplification.

FIG. 6 shows a linear gear with fluidic power amplification used as a energy converter 60. In this example, it is a hydraulic piston gear. The energy converter 60 is located in a valve assembly, which can be identical to FIG. 1 with respect to the paint path (arrows F) controlled by the valve needle 61. The generally cylindrical housing 62 of the valve assembly contains two cylinder chambers 622 and 623 lying axially one behind the other, sealed off from one another by a radial dividing wall 621. As shown in the illustration, a hollow cylinder 624 of relatively small diameter, coaxial to the housing 62 and fixedly connected to it and open to the cylinder chamber 622, extends from the dividing wall 621 into the cylinder chamber 622 and ends there in a radially-projecting fixed guide plate 625. The guide plate 625 is sealed at its periphery and sits inside a hollow cylindrical piston body 68 attached coaxially to the valve needle 61 and movable with it in the housing 62. The pressure spring 63 provided to close the valve and seated on its other side against the dividing wall of the housing 621 bears against the outer wall of said piston body 68 facing away from the valve needle 61. The movable piston 64 in the other cylinder chamber 623, which is driven in the manner described by control air DL, acts to open the valve. The piston 64 in this case is not attached to the valve needle 61, but extends axially movably into the stationary hollow cylinder 624 with a coaxially-projecting, cylindrical shaft 641. The interior of the hollow cylinder 624 has at 626 an opening into the intermediate space 627 formed between the fixed sealing guide plate 625 and the inner wall of the movable piston body 68 lying axially opposite thereto. This intermediate space 627 and the interior of the hollow cylinder 624 communicating with it are filled up to the end face of the piston shaft 641 with a hydraulic (or other suitable, possibly even "plastic") medium.

When the shaft 641 of the piston 64 is pushed into the hollow cylinder 624 by control air DL, the medium contained therein transmits this force to the piston body 68 by reversing its direction, which consequently opens the valve against the force of the spring 63. This brings about a gain in force equal to the ratio between the piston surfaces of the shaft 641 and the pressurized inner wall of the piston body 68.

Figure 7:
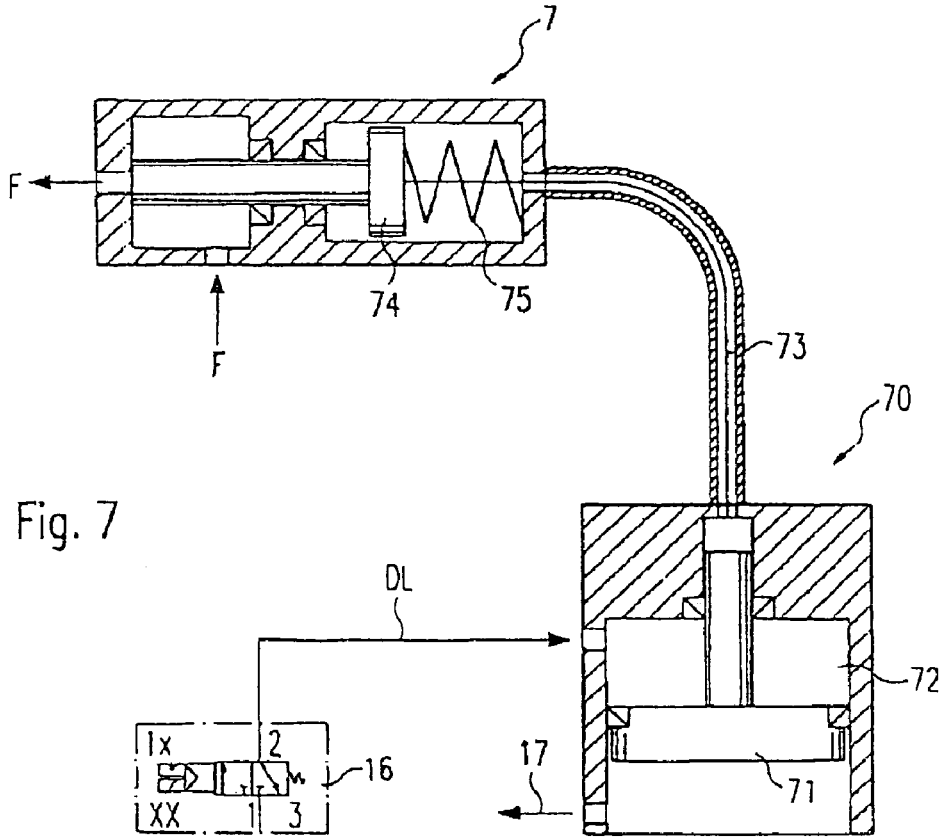
FIG. 7 is the schematic representation of a drive device with indirect force generation.

FIG. 7 represents a valve assembly 7 with indirect control drive. Its pneumatic drive device 70, to which control air DL is brought as the pressure medium, contains a cylinder space 72 similar to FIG. 1 in that the piston 71, which is pressurized by the pressure medium, can be moved. The pneumatic drive device 70 is located in this example outside the valve assembly 7 and is connected thereto by a preferably flexible mechanical connecting element, for example the Bowden cable shown with the customary wire pull 73. The wire pull 73 is attached at its one end to the piston 71 and at the other end to a connecting piston 74 located on the valve needle that is impinged upon by the pressure spring 75. For the rest, the valve assembly 7 is identical to the one in accordance with FIG. 1 and to this extent requires no explanation. The connecting piston 74 located in the valve assembly, which is pulled only by the wire 73 into the open position, can have a considerably smaller diameter than the external piston 71. The external piston 71 can generate a correspondingly high force for the miniaturized valve assembly 7 because, to a large extent, the piston surface can be of any size.

Figure 8:
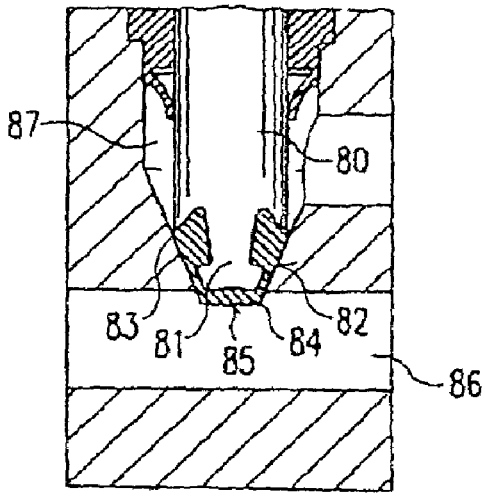
FIG. 8 is a useful embodiment of the sealing surface of a valve needle of the color changer.

As was already explained, miniaturization of the valve assembly can also be achieved by means to reduce the opposingly directed force which the drive device has to overcome, usually the valve closing force required for adequate sealing. One possibility for this is the valve needle 80 shown in FIG. 8 with a conical tip 81 on the radial outer side, whose linear cross-sectional sealing surface 82 abuts the matching conically-shaped surface of the valve seat 83 when the valve is closed. Under the invention, at least the sealing surface 82 of the valve needle 80 and/or that of the valve seat 83 is to consist of an elastomer material. In the example shown, an elastomer sheath 84 is applied, for example, by spray coating or vulcanization on an inner section of the needle tip 81, completely enclosing it. The face 85 of the needle tip in the closed position should at least approximately align with the wall of the central passage 86 common to all valve assemblies, so that no possible dead space is formed in the paint passage 87 of the valve assembly discharging there. The elastomer material of the sheath 84 is selected in consideration of the high requirements for durability of the valve and resistance to the paints and other media employed; plastics such as perfluoroelastomers are suitable.

Figure 9:
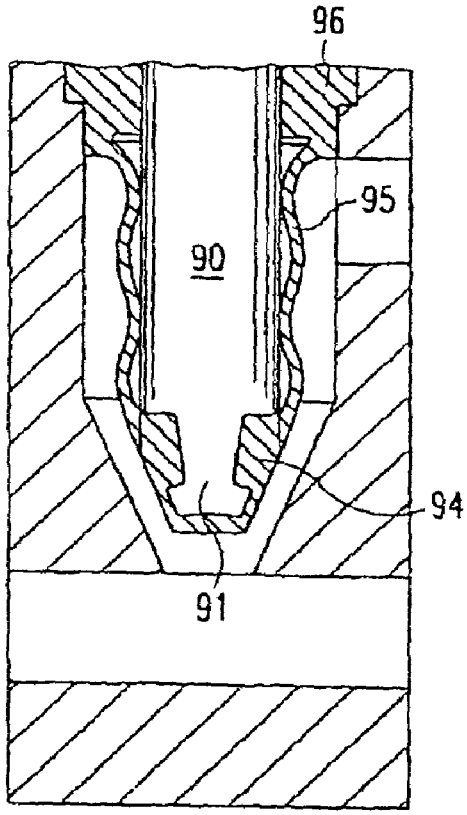
FIG. 9 is another embodiment of a valve needle of the color changer.

FIG. 9 shows another embodiment having a needle tip 91 for the valve needle 90 whose exterior is elastically yielding. The elastomer material 94 on the tip 91 is formed on here in one piece onto flexible bellows 95 that encloses the periphery of the needle 90 over a considerable part of its length to permit the necessary motion of the stroke and that can be attached to or formed onto a fixed seal 96 in which the needle 90 is guided. Such valves with good sealing properties can be particularly advantageous in color changers for 2K paints for example.

As a further possibility for better utilization of the available drive force, the use of a spring was mentioned initially whose force is greatest when the valve is closed and decreases with the opening stroke of the valve needle.

Figure 10:
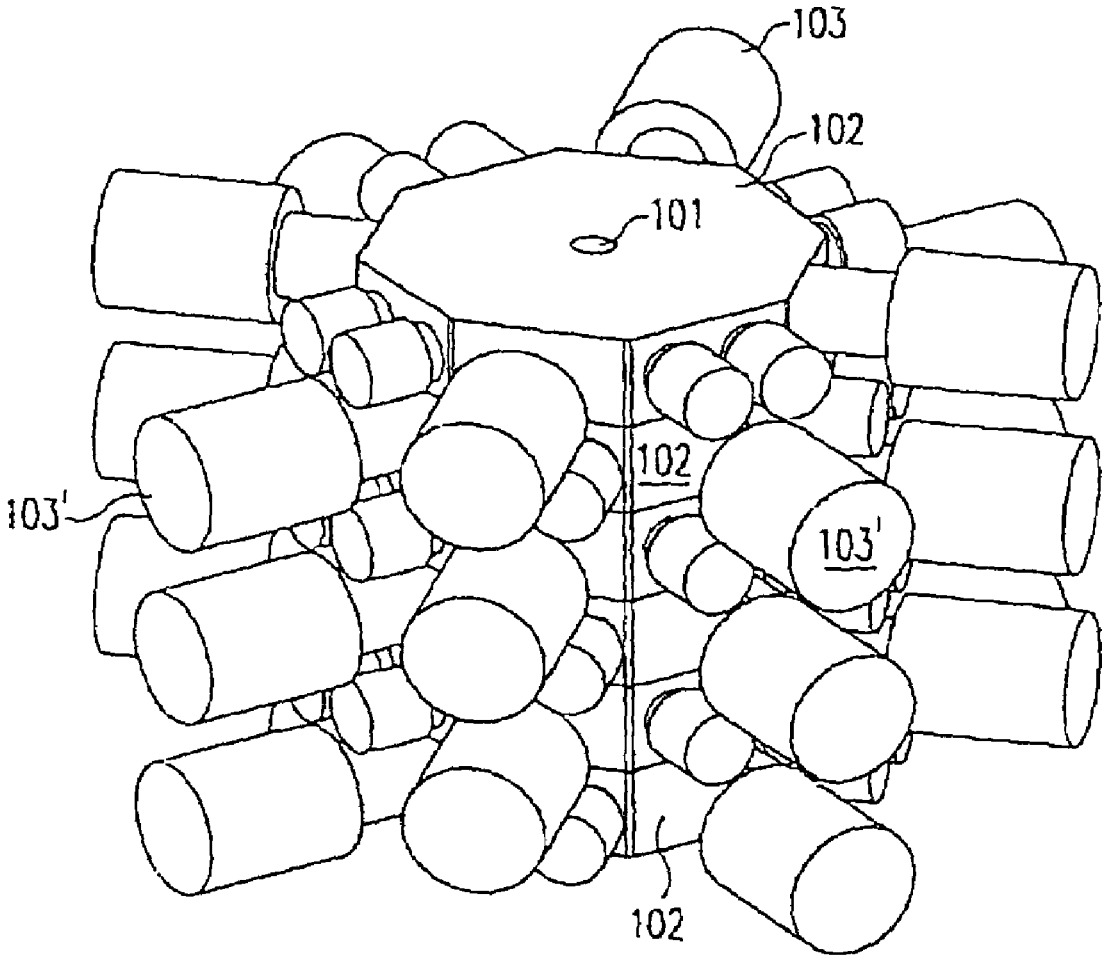
FIG. 10 is the schematic representation of a modular color changer with the valves in a star arrangement.

FIG. 10 shows a miniaturized color changer in the longitudinal direction of the central passage 101 common to all valve assemblies, for 24 colors in this example. It is composed of a plurality of segments 102 stacked in modular fashion along the central passage 101, each of which contains four star-shaped valve assemblies 103 or 103' distributed at equal angular intervals around the central passage 101. The needle axes of the assemblies in the example shown lie in a common plane perpendicular to the central passage 101. If the valve assemblies are intended to open in a known way into the central passage 101 with their needle axes at an angle different from 90°, at least the center points of the valve seats of the four valves lie in a common plane perpendicular to the central passage. To save even more space, the valve assemblies of adjacent segments 102 of the color changer, as shown in the drawing, are offset to each other in such a way that the valve assemblies 103 of one plane lie in each case in the middle between the adjacent valve assemblies 103' of the other plane in the circumferential direction of the central passage 101.

The arrangement shown in FIG. 10 of four pin valves disposed in a star in each plane of the modular manifold block of the color changer represents in many cases an optimum particularly with respect to paint change losses, which among other things depend on the required diameter of the central passage 101. If an even flatter shape is preferred, a greater number of valves can be distributed in one plane around the central passage 101, for example, six or eight valve assemblies. Undesirable paint change losses can be prevented here and in other embodiments by other measures, such as for example, by reducing the cross-section of the central passage 101 by means of a central internal body (c.f DE 102 12 601).

The possibility explained with reference to FIG. 10 of shortening the required length of the common central passage through the offset-angle arrangement of the valve assemblies 103 and 103' is not restricted to the example described with several valve assemblies distributed in each plane around the central passage, but can be applied in general to reduce the space required perpendicular to the central passage, going so far as the placement of only two valve assemblies or even only one valve assembly in each plane. For example, in the last-named case, a single row of valve assemblies can be disposed along the central passage, in which adjacent valve assemblies along the central passage are offset to each other by a suitably selected angle, for example approximately 45°, so that two nested groups of valve assemblies is created, each aligned with the other in the longitudinal direction of the central passage. The offset angle should be as small as possible on the one hand to save space in the direction perpendicular to the central passage and perpendicular to the two valve groups; but on the other hand it must be selected such that the distance between the needle axes measured in the longitudinal direction of the central passage is smaller than the maximum diameter of the valve assemblies similarly measured in this longitudinal direction if there is to be any space saving in the longitudinal direction of the central passage. The mutual distance between the longitudinal needle axes of the adjacent valve assemblies should thus be smaller than the minimum distance which they would have to have for the same outside dimensions of the valve assemblies, if the neighboring valve assemblies were to be aligned with each other without angular offset, as with known color changers.

Figure 11:
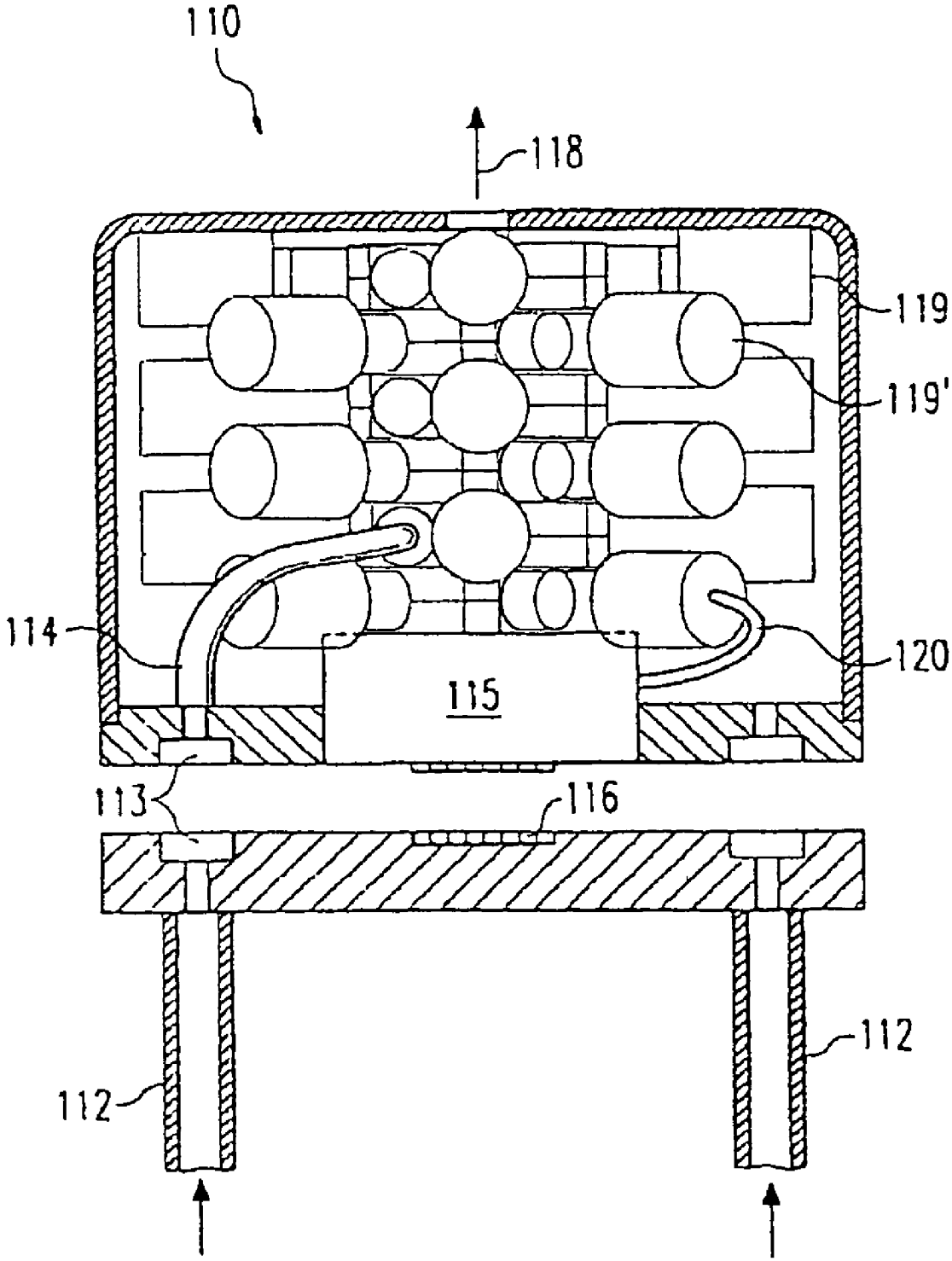
FIG. 11 is the schematic representation of a color changer having a quick-change coupling array.

A color changer 110 is shown schematically in FIG. 11 that is connected by way of a quick-change coupling arrangement to its supply lines. In particular, the necessarily numerous paint lines like 112 can be connected by quickly detachable and closeable couplings 113 to short hose sections 114 inside the color changer 110. If the color changer 110 contains electrically-controlled pilot valves and an electronic control unit for them 115, an electrical plug 116 for the preferred field bus control of the control unit 115 can be furnished. Suitable quick-change couplings are know in the art, including those which permit quick separation of hoses under pressure and/or filled with paint. The color changer shown in FIG. 11 can otherwise be identical, for example, to the valve arrangement in accordance with FIG. 10. Accordingly, the outlet for the common central passage is identified as 118, two valve assemblies of adjoining planes offset to each other in the circumferential direction as 119 and 119' and the line connected to a valve assembly for control air (DL in FIG. 1, etc.) as 120.

What is claimed is:

1. A color change valve arrangement for selectively connecting an applicator of a coating plant to a plurality of supply lines for coating material of different selectable colors, the arrangement comprising:

a plurality of valve assemblies, each of the plurality of valve assemblies associated with at least one of the selectable colors and each of the plurality of valve assemblies including:

an outlet port through a valve housing for the coating material flowing toward the applicator, the outlet port forming a valve seat;

a valve needle movably carried in the valve housing, the valve needle having a sealing surface abutting the valve seat when the valve is closed;

at least one piston connected to the valve needle, the at least one piston operable by a pressure medium to move the valve needle;

means for exerting a force on the valve needle, the exerting means positioned to exert the force oppositely directed to pressure from the pressure medium; and at least one drive device for applying the pressure medium to the at least one piston; and a common passage wherein an outlet port of each of the plurality of valve assemblies open into the common passage wherein at least two of the plurality of valve assemblies having valve needle places parallel to each are disposed next to each other along the common passage; and wherein each of the plurality of valve assemblies further comprises means for at least one of amplifying a force exerted by the drive device on the piston and reducing a force in the opposite direction that the drive device is operable to overcome.

2. The color change valve arrangement according to claim 1 wherein the means for at least one of amplifying and reducing further comprises at least one of:

an elastomer material forming a sealing surface on at least one of the needle valve opposite a surface of the valve seat and the surface of the valve seat;

the exerting means including a spring having a degressive characteristic;

a non-circular cross-section on a surface of the piston pressurized by the pressure medium;

a pressure source supplying the pressure medium at a pressure of more than 10 bar;

the drive device including at least two piston surfaces disposed behind one another along an axis of motion of the piston, each of the piston surfaces pressurized by the pressure medium;

an energy converter included in the drive device to increase the force of the pressure medium; and a flexible mechanical drive element coupled to the drive device wherein the drive device is located outside the respective valve assemblies.

3. The color change valve arrangement according to claim 2 wherein the energy converter contains a device in which a linearly movable input element drives a linearly movable output element by means of a rotatable intermediate element.

4. The color change valve arrangement according to claim 2 wherein the energy converter is formed by at least two racks carried movably relative to each other, the at least two racks coupled by means of a pinion gear.

5. The color change valve arrangement according to claim 2 wherein the energy converter is formed by a gear with two ball screws having different thread pitches carried movably relative to each other.

6. The color change valve arrangement according to claim 2 wherein the energy converter is formed by a piston gear in which the ratio of force transmitted is determined by differently sized piston surfaces.

7. The color change valve arrangement according to claim 2 wherein the sealing surface further comprises an elastomer sheath formed onto bellows enclosing the periphery of the valve needle, the sealing surface attached stationary at its end facing away from a needle tip relative to the valve needle.

8. The color change valve arrangement according to claim 1 wherein at least two valve assemblies whose outlet ports lie in a common plane running perpendicular to a longitudinal axis of the common passage are disposed distributed around the longitudinal axis of the common passage.

9. The color change valve arrangement according to claim 1 wherein at least two adjacent valve assemblies in a longitudinal direction of the common passage are disposed offset around the common passage with an angular distance between their needle axes of less than 90° and the distance between the needle axes measured in the longitudinal direction of the common passage is less than the maximum diameter of the valve assemblies similarly measured in this longitudinal direction.

10. The color change valve arrangement according to claim 9 wherein at least two valve assemblies whose outlet ports lie in a common first plane running perpendicular to the longitudinal axis of the common passage are disposed distributed around the longitudinal axis of the common passage and wherein at least two additional valve assemblies whose outlet ports lie in a second plane parallel to the first plane are disposed around the longitudinal axis of the common passage distributed such that the valve assemblies of the one plane lie between the valve assemblies of the other plane in the circumferential direction of the common passage.

11. The color change valve arrangement according to claim 10 wherein at least three valve assemblies with equal angular distances are disposed distributed around the longitudinal axis of the common passage.

12. The color change valve arrangement according to claim 1, further comprising:

a pressure line common to each of the plurality of valve assemblies from which the pressure medium is brought to the valve assemblies and wherein each of the plurality of valve assemblies has an electrically controlled valve interposed between its piston and the common pressure line.

13. The color change valve arrangement according to claim 1, further comprising:

a quick-change coupling array for connecting lines of the valve assemblies.

* * * * *